United States Patent [19]

Sutherland

[11] Patent Number: 4,611,754

[45] **Date of Patent: * Sep. 16, 1986**

[54] MODIFIED LOCK ARRANGEMENT FOR CARTONS

[75] Inventor: Robert L. Sutherland, Campbell Hall, N.Y.

[73] Assignee: Federal Paper Board Co., Inc., Montvale, N.J.

[ * ] Notice: The portion of the term of this patent subsequent to Jul. 2, 2002 has been disclaimed.

[21] Appl. No.: 726,984

[22] Filed: Apr. 25, 1985

Related U.S. Application Data

[63] Continuation-in-part of Ser. No. 358,879, Mar. 16, 1982, Pat. No. 4,526,316.

[51] Int. Cl.[4] ..... B65D 75/00

[52] U.S. Cl. ..... 229/40; 206/140; 206/152; 206/157; 206/434; 229/148; 229/45 R

[58] Field of Search ..... 206/140, 152, 156, 157, 206/174, 141, 145, 429, 434; 229/38, 39 R, 40, 45 R; 24/204

[56] References Cited

U.S. PATENT DOCUMENTS

| | | | |
|---|---|---|---|
| 3,014,636 | 12/1961 | Fielding | 229/39 R |
| 3,288,349 | 11/1966 | Palmer et al. | 229/45 |
| 3,655,117 | 4/1972 | Weiss | 229/40 |
| 3,705,681 | 12/1972 | Rossi et al. | 206/140 X |
| 4,200,220 | 4/1980 | Ganz | 229/40 |
| 4,526,316 | 7/1985 | Sutherland | 229/40 |

*Primary Examiner*—William Price
*Assistant Examiner*—Bryon Gehman
*Attorney, Agent, or Firm*—Charles E. Brown; Charles A. Brown

[57] ABSTRACT

This relates to a closure panel and lock arrangement for cartons of the wrap around type. The customary secondary lock includes at least one, and preferably two, male locking tabs which have a locking projection on one side only of a narrow neck and defining a locking shoulder. The male locking tab is associated with a separate female locking slot in an inner closure panel immediately adjacent its folded connection with a side panel of the carton wherein the female locking slot is formed by a single knife arrangement forming first and second cut lines without the removal of material. The shapes of the cut lines provide for automatic opening of the female locking slot when the inner closure panel is folded relative to an adjacent side panel and there is defined a flexible locking ear which will lock behind the shoulder of the male locking tab.

8 Claims, 6 Drawing Figures

MODIFIED LOCK ARRANGEMENT FOR CARTONS

This application is a continuation-in-part of my copending application Ser. No. 358,879, Mar. 16, 1982 now U.S. Pat. No. 4,526,316, granted July 2, 1985.

This invention relates in general to new and useful improvements in cartons of the wrap around type, and more particularly to a lock arrangement for locking together closure panels of such cartons.

In a prior type of closure panel and lock arrangement, there is an inner closure panel and an outer closure panel with the inner closure panel having large openings therein extending generally from a fold line connecting the inner closure panel to a side panel of a carton. Along this fold line at one side of each opening is a slot for receiving a male locking tab of a secondary lock. The opposite side of the opening defines a ledge behind which a primary locking tab engages.

In accordance with this invention there is provided a new female slot arrangement which includes a first cut line defining at one end thereof a locking ear and a second cut line intersecting the first cut line at a side of the ear extending away from the first cut line whereby the ear is free to deflect for receiving and having locked therebehind a shoulder of a male locking tab. The female slot arrangement, by being formed at and immediately adjacent the fold line connecting the associated closure panel with a side panel of a carton is defined solely by cut lines and when the panels are folded generally at right angles to each other, a slot for receiving the male locking tab is automatically formed.

Most particularly, this invention relates to an arrangement wherein there is insufficient space for the male locking tab to have locking shoulders on both sides of a narrow neck. Accordingly, the male locking tab has but a single shoulder which locks behind a single ear defined by the female slot arrangement with the neck of the male locking tab passing through a straight portion of the opening defined by the female slot arrangement.

With the above and other objects in view that will hereinafter appear, the nature of the invention will be more clearly understood by reference to the following detailed description, the appended claims, and the several views illustrated in the accompanying drawing.

Figures 1, 2, 3, 4, 5, 6:
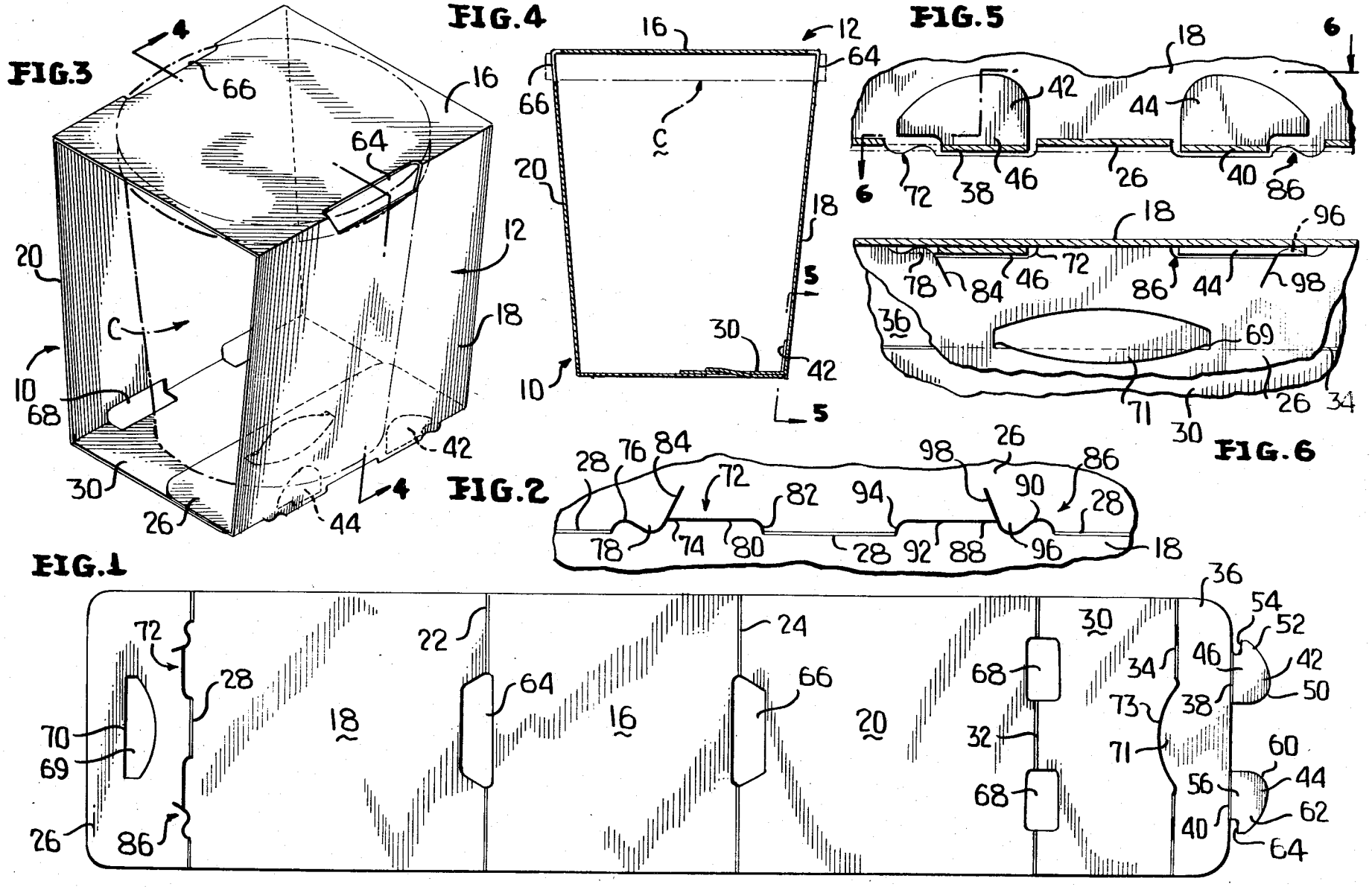
FIG. 1 is a plan view of a typical carton blank of the type employing the closure panel and locking arrangement of this invention.
FIG. 2 is an enlarged fragmentary plan view of the blank of FIG. 1 showing the specific details of the cut lines defining the female slot arrangement.
FIG. 3 is a perspective view with parts broken away of a typical wrap around carton package arrangement formed in accordance with this invention.
FIG. 4 is an enlarged transverse vertical sectional view taken generally along the line 4—4 of FIG. 3 and shows further the details of the closure panel arrangement and lock structure.
FIG. 5 is an enlarged fragmentary longitudinal vertical sectional view taken generally along the line 5—5 of FIG. 4 and shows the specific relationship of the male locking tab and the female slot arrangement.
FIG. 6 is a fragmentary horizontal sectional view taken generally along the line 6—6 of FIG. 5 and shows further the relationship of the male locking tab and the female slot arrangement.

Referring now to FIGS. 3 and 4 of the drawing in detail, it will be seen that there is illustrated a typical package, generally identified by the numeral 10, utilizing a carton, generally identified by the numeral 12, incorporating closure panels and locking means in accordance with this invention. The carton 12, which is merely illustrative of an application of the invention, is formed from a blank generally identified by the numeral 14 and specifically shown in FIG. 1.

The blank 14 is of an elongated generally rectangular configuration and is preferably formed of paperboard. The blank 14 includes a central top panel 16 having disposed on opposite sides thereof side panels 18 and 20 which are connected to the top panel 16 along fold lines 22, 24, respectively.

The blank 14 also includes an inner closure panel 26 which is connected to the side panel 18 along an interrupted fold line 28, and an outer closure panel 30 which is connected to the side panel 20 along an interrupted fold line 32. The closure panel 30 is provided with a transverse fold line 34 which sets off a terminal flap 36.

The flap 36 has connected thereto along fold lines 38, 40 male locking tabs 42, 44. The locking tabs 42, 44 are of like construction and preferably are of left and right hand arrangements.

The locking tab 42 has a narrow neck 46 which is directly joined to the fold line 38 and a generally rounded head 50 which terminates in a projecting ear 52 which is spaced from the flap 36 to define a locking shoulder 54.

The male locking tab 44 has a narrow neck 56 terminating in a rounded head 60 which defines a locking ear 62 and which ear has a shoulder 64 which is spaced from and faces the free edge of the flap 36.

In order that the carton 12 may interlock with a container C, the side panels 18, 20 may be provided with upper, centrally located, openings 64, 66 which may extend into the top panel 16 and extend across the fold lines 22, 24, respectively.

In order that the carton 12 may also interlock with a bottom portion of the container C, the fold line 32 may be interrupted by openings 68 which are formed partially in the side panel 20 and in the closure panel 30 and which are spaced from one another along the fold line 32.

The carton 12 has a primary lock which includes an opening 69 which is formed in the closure panel 26 and includes a shoulder 70 which faces away from the free edge of the closure panel 26. The primary lock also includes a male locking tab 71 defined by arcuate cut line 73 formed in the closure panel 30 with the male locking tab 71 being carried by the flap 36.

This invention particularly relates to the secondary lock of which the male locking tabs 42 and 44 form parts and more particularly to a female slot arrangement formed in the closure panel 26 along the fold line 28 for each of the male locking tabs 42, 44. A female slot arrangement 72 for the male locking tab 42 includes a first cut line 74 which at one end thereof has a reversing portion of a generally S-shaped configuration as at 76 to define a locking ear 78. The cut 74 includes a straight line portion 80 which terminates in a turned end portion 82 which extends back to the fold line 28.

The female slot arrangement 72 is also defined by a second cut line 84 which intersects the cut line 74 at the intersection between the S-shaped reversing portion 76 and the straight line portion 80 and is generally a tangential continuation of one end of the S-shaped reversing portion 76. The second cut line 84 permits the deflection of the locking ear 78 for the reception of the male locking tab 42 so that the shoulder 54 of the tab 42 may pass behind the ear 78 and lock therebehind.

The female slot arrangement for the male locking tab 44 is identical to the female slot arrangement 72 but of a different hand so as to match the male locking tab 44. This female slot arrangement is identified by the numeral 86 and is defined by a first cut line 88 including a generally S-shaped reversing portion 90 and a straight line portion 92 with the straight line portion terminating remote from the S-shaped reversing portion in a curved end portion 94 which extends towards and terminates at the fold line 28. The S-shaped reversing portion 90 defines a locking ear 96 which corresponds to the locking ear 78.

The female slot arrangement 86 is also defined by a second cut line 98 which intersects the first cut line 88 at the intersection between the S-shaped portion 90 and the straight line portion 92. The second cut line 98 extends generally as a continuation of that part of the S-shaped portion 90 which is joined to the straight line portion 92.

At this time it is pointed out here that the female slot arrangements 72 and 86 are of a left and right hand relation and if one combines the female slot arrangements 72 and 86, the net result is a double ear arrangement of the type disclosed in my above-identified application. The same is also true of the relation of the two male locking tabs 42, 44 and if one combines the two male locking tabs 42, 44 and forms a single male locking tab having shoulders on opposite sides of a narrow neck.

At this time it is pointed out here that the specific details of the female locking slots 72 and 86 are best illustrated in FIG. 2.

The illustration of FIGS. 5 and 6 is directed to the lock between the male locking tab 42 and the female locking slot 72 with the shoulder 54 being locked behind the ear 78. It is to be understood that a like relationship will exist between the female locking slot 86 and the male locking tab 44.

Although only a preferred embodiment of the invention has been specifically illustrated and described herein, it is to be understood that minor variations may be made in the male locking tab and female slot configuration without departing from the spirit and scope of the invention as defined by the appended claims.

I claim:

1. For use in a carton lock of the type including a male locking tab joined to such carton by a narrow neck and having a locking shoulder on one side of said neck, an improved lock including a female slot arrangement formed in said carton for receiving the male locking tab, said female slot arrangement comprising a single linearly continuous first cut line including a straight line portion terminating in a reversing portion defining a locking ear, and a second cut line intersecting said first cut line at an adjacent side of said ear and extending away from said straight line portion wherein said ear is free to deflect.

2. A lock arrangement according to claim 1 wherein said reversing portion is generally S-shaped in outline.

3. A lock arrangement according to claim 1 wherein said reversing portion is generally S-shaped in outline and said second cut line forms a continuation of that part of said reversing portion joined to said straight line portion.

4. A lock arrangement according to claim 1 wherein said second cut line forms a continuation of that part of said reversing portion joined to said straight line portion.

5. A lock arrangement according to claim 1 wherein said carton includes first and second adjacent panels joined by a fold line, said first and second cut lines being formed in said first panel with said first cut line extending generally along said fold line and defining a slot in said first panel parallel to and adjacent to said fold line when said first and second panels are folded relative to each other.

6. A lock arrangement according to claim 5 wherein said first and second panels are folded generally at right angles to each other with said first panel being a first closure panel, said carton including a second closure panel underlying said first closure panel and carrying said male locking tab, said male locking tab projecting through said slot and having said locking shoulder projecting beyond said locking ear and engaged by said locking ear with said neck being aligned with said straight line portion, and said male locking tab being disposed alongside said second panel.

7. A lock arrangement according to claim 5 wherein said locking ear has a tip offset from a center of said fold line.

8. A lock arrangement according to claim 1 wherein there are two of said male locking tabs and two of said female slot arrangements, and said male locking tabs and said female slot arrangements are of left and right hand relation.

* * * * *